United States Patent [19]

Reinartz et al.

[11] 4,318,078

[45] Mar. 2, 1982

[54] BRAKE FLUID LEVEL WARNING APPARATUS

[75] Inventors: Hans-Dieter Reinartz; Horst Quitmann, both of Frankfurt am Main, Fed. Rep. of Germany

[73] Assignee: ITT Industries, Inc., New York, N.Y.

[21] Appl. No.: 157,742

[22] Filed: Jun. 9, 1980

[30] Foreign Application Priority Data

Jul. 24, 1979 [DE] Fed. Rep. of Germany ..... 2929858
Jul. 24, 1979 [DE] Fed. Rep. of Germany ..... 2929941

[51] Int. Cl.[3] ..... G08B 21/00
[52] U.S. Cl. ..... 340/59; 340/624; 200/84 R
[58] Field of Search ..... 340/52 B, 59, 618, 623, 340/624; 73/307; 200/84 R

[56] References Cited

U.S. PATENT DOCUMENTS 3,609,680 9/1971 Belart ..... 340/59

*Primary Examiner*—Alvin H. Waring
*Attorney, Agent, or Firm*—John T. O'Halloran; Alfred C. Hill

[57] ABSTRACT

The brake fluid reservoir warning arrangement responds when the fluid level drops below a predetermined minimum level and includes two contact pins and a contact disc arranged on a float to electrically connect the contact pins when the fluid level is below the minimum level. Checking arrangements to check the warning arrangement are disclosed which include manual swivelling or axially displacing the contact pins to make an electrical connection with the contact disc, or the contact carrier includes an opening accessible to both contact pins receiving a metal part to electrically connect the two contact pins together.

32 Claims, 6 Drawing Figures

BRAKE FLUID LEVEL WARNING APPARATUS

BACKGROUND OF THE INVENTION

The present invention relates to a brake fluid reservoir warning arrangement which responds when the fluid level drops below a predetermined minimum, comprising two contact pins and a contact disc arranged at a float to electrically connect the contact pins when the fluid level is low, and with a checking arrangement to check the reservoir warning arrangement.

Such brake fluid reservoirs with a warning arrangement and a checking arrangement to check the warning arrangement are known. German Patent DE-OS No. 2,345,870, for instance, shows a brake fluid reservoir of the type referred to. The warning arrangement is disposed in a domal member which is integrally formed with the upper part of the brake fluid reservoir. The rod of the float extends from below into the domal member and carries close to the upper end an annular contact plate. Two contact pins extend into the domal member laterally so that their contact rivets are underneath the contact disc which establishes a connection between the two contact pins when the fluid level is at its predetermined minimum. At its upper end the domal member possesses a kind of thimble made from compressible plastics.

Extending into the thimble is the upper end of the float rod. To check the function of the warning arrangement, the thimble-shaped member is compressed which displaces the float rod downwards. The contact disc connects the two contact pins, and the warning arrangement indicating that the brake fluid level is too low and must go on. If this is not the case, the indicator circuit is defective.

In these known warning arrangements, a compromise must be arrived at when dimensioning the thimble shaped parts because these parts must be so rigid that they are able to withstand the pressure occurring when the brake system is filled with brake fluid and at the same time they must remain elastic enough to be pressed down without major effort for a check of the reservoir warning arrangement. These are partly contradictory requirements.

SUMMARY OF THE INVENTION

Therefore, an object of the present invention is to provide a simpler design for the checking arrangement of the reservoir warning arrangement in which the dimensioning problem of the above-identified prior art is eliminated.

A feature of the present invention is the provision of a brake fluid reservoir warning arrangement which responds when the fluid level drops below a predetermined minimum level comprising: two spaced contact pins extending into the reservoir; a contact disc disposed on a float in the reservoir to electrically connect the contact pins together when the fluid level drops below the minimum level to light a lamp in a warning indicator circuit; and a checking arrangement to check the warning arrangement including a manually operated arrangement associated with the contact pins to provide an electrical connection therebetween to light the lamp when the warning indicator circuit is intact.

In this arrangement, the contact pins may be axially displaceable or swivelling. In order to ensure unambiguous contact-making, the contact disc is suitably adapted to the type of movement. For example, if the contact pins move axially, the rim of the contact disc will be somewhat reinforced or beaded.

By thus constructing the checking arrangement according to this invention, thimbles, caps, or like parts projecting beyond the cover are avoided, resulting in a flatter overall design of the warning arrangement.

According to further features of this invention, each contact pin is carried in a plastic ring and/or in an annular member of the contact carrier, wherein the annular member of the contact carrier engages into an annular groove in the contact pin, thereby preventing the contact pin being disengaged unintentionally, and the elasticity of the plastic rings returns the contact pins to their normal positions. It is also possible to provide for return of the contact pins into their normal positions by spring action.

In another embodiment the above named object is achieved according to the present invention is that the contact carrier includes an opening coextensive with both contact pins and receiving a metal member.

In this arrangement, the opening may be designed like a slot which, in a particularly advantageous embodiment, is conformed to the shape of a coin so that merely a coin has to be inserted into the slot to check the warning arrangement.

In another embodiment, the opening may be of circular or rectangular design and may accommodate a spring-mounted metal member which is larger than the space between the contact pins. The metal member may be adapted to be pushed down by any pin so that a contact is established. It will, however, be suitable to provide in the opening a pushbutton conformed to the opening to electrically connect the two contact pins. It is also possible to fasten the metal part to the pushbutton.

BRIEF DESCRIPTION OF THE DRAWING

Above-mentioned and other features and objects of this invention will become more apparent by reference to the following description taken in conjunction with the accompanying drawing, in which:

In FIGS. 1—3 and 5, only the upper part of the brake fluid reservoir, the contact carrier 10, is shown. Contact carrier 10 posseses bores 11 to receive the two contact pins 12. Contact pins 12 have at their ends outside contact carrier 10 contact plugs or knobs 15 and at their opposite ends contacts 16. The middle portion 22 of each contact pin 12 has an annular groove 23 engaged by an annular member 13. Contact pin 12 is carried on annular member 13 and on a plastic ring 14 which is arranged in an annular groove formed in contact carrier 10. Annular member 13 is integral with contact carrier 10 and the brake fluid reservoir and is of such triangular cross-section that a surface extending normal to contact pin 12 prevents the contact pin being disengaged unintentionally. The surface extending in an inclined relationship to contact pin 12 facilitates engagement of the contact pins into contact carrier 10. Further, FIG. 1 shows float rod 17 which carries contact disc 18 at its upper end. The direction of swivelling movement of contact pin 12 is indicated on contact 16 by a double arrow 20.

Figure 1:
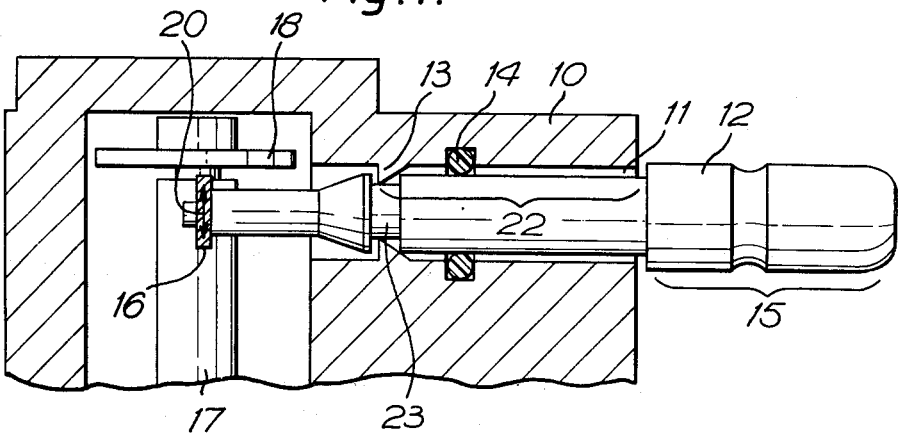
FIG. 1 is a partial cross-sectional view of a first embodiment of a brake fluid reservoir having a warning arrangement in accordance with the principles of the present invention with swivelling contact pins.

To check the warning arrangement, contact pin 12 is pressed downwards compressing plastic ring 14 resulting in a swivelling movement of contact 16 around annular member 13 as indicated by arrow 20. In this movement, contacts 16 will make contact with contact disc 18, thus establishing an electrical connection. This will cause a warning lamp conventionally fitted to the instrument panel to light up. Plastic ring 14 should be so elastic as to return contact pins 12 into their normal positions. Should this be not possible because of lack of elasticity, the added provision of a spring is necessary to return contact pins 12 into their normal positions.

Figure 2:
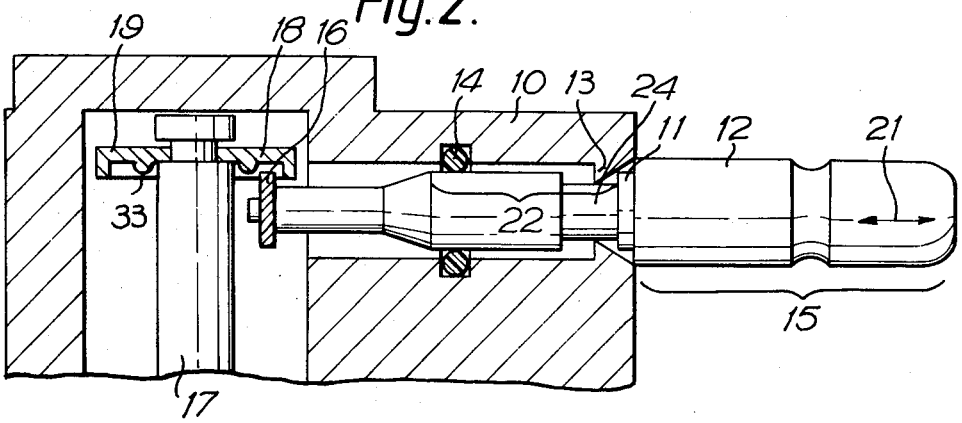
FIG. 2 is a partial cross-sectional view of a second embodiment of a brake fluid reservoir having a warning arrangement in accordance with the principles of the present invention with axially displaceable contact pins.

FIG. 2 shows an arrangement in which the check is performed by axial movement of contact pins 12. Like parts have been assigned like reference numerals. In contrast to FIG. 1, annular member 13 is arranged at the end of bore 11 close to knob 15. In FIG. 2, plastic ring 14 is provided at the opposite end of bore 11. The arrangement of plastic ring 14 and of annular member 13 is not actually of material importance with regard to the mode of operation of the checking arrangement. For example, it is also possible to arrange annular member 13 in FIG. 2 in a manner similar to FIG. 1. When dimensioning annular groove 24 in middle portion 22 of contact pin 12, the axial movement chosen requires that allowance be made for the actuating distance, i.e., annular groove 24 must be suitably longer then annular groove 23 of FIG. 1. Further, in contrast to FIG. 1, contact disc 18 posseses a reinforced or beaded rim 19. This is necessary to ensure contact making between contact pins 12 and contact disc 16 when the contact pins move axially as indicated by double arrow 21. The mode of operation of the checking arrangement is practically similar to the one described with reference to FIG. 1. The only difference is that in FIG. 2 contact pins 12 are moved axially. It is also possible to provide on an inner radius of contact disc 18 a partially thickened elevation such as at 33 if it is desired to check the warning arrangement by pressing in contact pins 12, instead of by pulling them out.

In the embodiment providing for axial displacement of contact pins 12, it will be appropriate to use a spring to return contact pins 12 into their normal position, unless it is preferred to perform the return function by hand.

Figure 3:
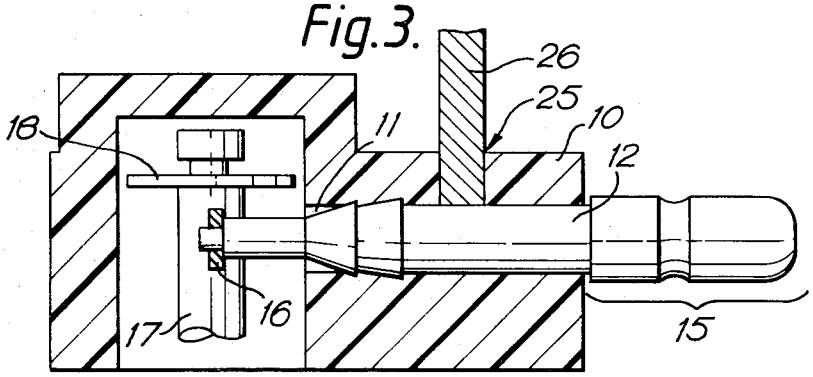
FIG. 3 is a partial cross-sectional view of a third embodiment of a brake fluid reservoir having a warning arrangement in accordance with the principles of the present invention in which the connection between the two contact pins is established by an additionally required metal member, for instance, a coin.
Figure 5:
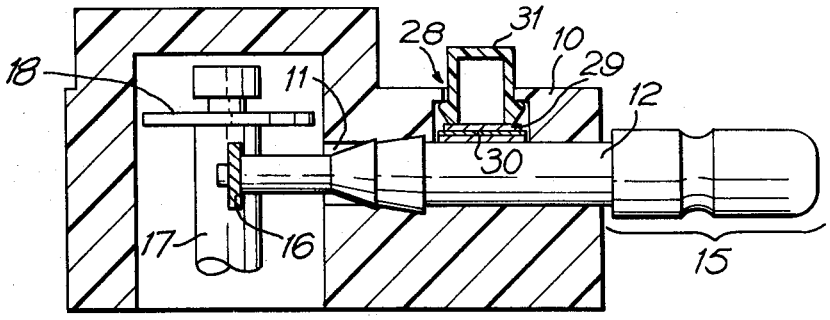
FIG. 5 is a partial cross-sectional view of a fourth embodiment of a brake fluid reservoir having a warning arrangement in accordance with the principles of the present invention in which the electrical connection between the control pins is established by a pushbutton.

In FIGS. 3 and 5, contact carrier 10 forms the upper part of the brake fluid reservoir not shown in greater detail. Control pins 12 are located in bores 11 of contact carrier 10. Only the part of contact pins 12 designed as a contact plug 15 extends out of contact carrier 10. Disposed at the opposite ends of contact pins 12 are contacts 16. Above contacts 16 is contact disc 18 which is fastened to float rod 17. If the fluid in the brake fluid reservoir drops, the float will follow this movement and control disc 18 will touch contacts 16, thus connecting the two contact pins 12. This will cause a lamp conventionally fitted to the vehicle's instrument panel to light up. This operation of the warning arrangement is identical to that of the embodiments of FIGS. 1 and 2.

Figure 4:
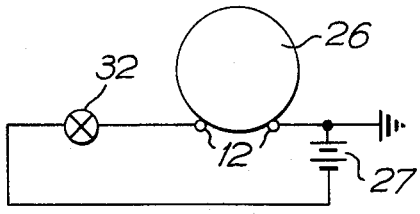
FIG. 4 is a schematic diagram of an electric circuit employed with the embodiment of FIG. 3.
Figure 6:
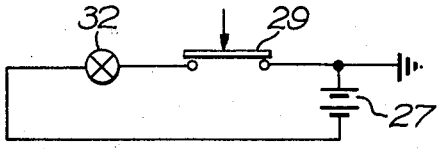
FIG. 6 is a schematic diagram of an electric circuit employed with the embodiment of electric circuit FIG. 5.

In the embodiment of FIG. 3, a slot-shaped opening 25 is provided corresponding in size and form to a metal coin 26. When coin 26 is inserted into slot 25, the two contacts 12 will be bridged as illustrated in the circuit diagram of FIG. 4 and lamp 32, the lamp normally connected in the warning arrangement electric circuit, will light up. Thus, the operability of the electrical warning arrangement can be checked without difficulty. In the circuit diagrams of FIGS. 4 and 6, the vehicle's battery has been assigned reference character 27.

In the embodiment of FIG. 5, opening 28 may be of circular or rectangular shape. In the normal position, a metal disc 29 is at a specific distance from contact pins 12 so that these are disengaged from each other. This distance, which prevents an indication in the normal position, is maintained by a spring 30. Pushbutton 31 extends outwardly, and on its depression the two contact pins 12 are electrically connected to each other through metal disc 29. As indicated in the circuit diagram of FIG. 6, indicator lamp 32 will go on in this case, thus, signalling that the electric circuit of the warning arrangement is OK. On release of the pushbutton, metal disc 29 will be disengaged from contact pins 12 by the spring action of spring 30. Metal disc 29 may be integrally formed with pushbutton 31.

This invention is not limited to the embodiments illustrated, but any other metallic member may be substituted for coin 26 of FIG. 3. Neither is it absolutely necessary in the embodiment of FIG. 5 to use a pushbutton. The checking device may include only metal disc 29 and spring 30. In this case, metal disc 29 can be depressed by means of a suitable tool.

While we have described above the principles of our invention in connection with specific apparatus it is to be clearly understood that this description is made only by way of example and not as a limitation to the scope of our invention as set forth in the objects thereof and in the accompanying claims.

We claim:

1. A brake fluid reservoir warning arrangement which responds when the fluid level drops below a predetermined minimum level comprising:

two spaced contact pins extending into said reservoir;

a contact disc disposed on a float in said reservoir to electrically connect said contact pins together when said fluid level drops below said minimum level to light a lamp in a warning indicator circuit; and a checking arrangement to check said warning arrangement including a manually operated arrangement associated with said contact pins to provide an electrical connection therebetween to light said lamp when said warning indicator circuit is intact, said manually operated arrangement including a knob on the end of said contact pins remote from said float to enable manual axial displacement of said contact pins and said contact disc is thickened on a diametric circle thereof to provide said electrical connection between said contact pins when they are axially displaced.

2. A reservoir warning arrangement according to claim 1, wherein said manually operated arrangement includes a rim on the outer periphery of said contact disc extending toward said contact pins to provide said electrical connection between said contact pins when they are axially displaced away from said float.

3. A reservoir warning arrangement according to claim 1, wherein said manually operated arrangement includes a thickened portion on a diametric circle of said contact disc extending toward said contact pins spaced inwardly from the outer periphery of said contact disc to provide said electrical connection between said contact pins when they are axially displaced toward said float.

4. A reservoir warning arrangement according to claim 1, wherein each of said contact pins are supported by an annular member projecting into an associated bore contained in a contact carrier fastened to said reservoir.

5. A reservoir warning arrangement according to claim 1, wherein each of said contact pins are supported by a plastic ring secured in the inner surface of an associated bore contained in a contact carrier fastened to said reservoir.

6. A reservoir warning arrangement according to claim 1, wherein each of said contact pins are supported by an annular member projecting into an associated bore contained in a contact carrier fastened to said reservoir and a plastic ring secured in the inner surface of said associated bore.

7. A reservoir warning arrangement according to claim 6, wherein each of said annular members engage an annular groove of an associated one of said contact pins.

8. A reservoir warning arrangement according to claim 7, wherein each of said annular members has a triangular cross-section.

9. A reservoir warning arrangement according to claim 8, wherein a surface of said triangular cross-section extending perpendicular to said contact pins engages said annular groove to prevent said contact pins from being pulled out of said contact carrier.

10. A reservoir warning arrangement according to claim 9, wherein each of said annular members is disposed adjacent the end of said associated bore remote from said float.

11. A reservoir warning arrangement according to claim 10, wherein each of said plastic rings is disposed adjacent the end of said associated bore adjacent said float.

12. A reservoir warning arrangement according to claim 11, wherein each of said contact pins are returned to their normal position by hand.

13. A brake fluid reservoir warning arrangement which responds when the fluid level drops below a predetermined minimum level comprising:

two spaced contact pins extending into said reservoir;

a contact disc disposed on a float in said reservoir to electrically connect said contact pins together when said fluid level drops below said minimum level to light a lamp in a warning indicator circuit; and a checking arrangement to check said warning arrangement including a manually operated arrangement associated with said contact pins to provide an electrical connection therebetween to light said lamp when said warning indicator circuit is intact, said manually operated arrangement enables manual swivelling of said contact pins to enable physical contact with said contact disc to provide said electrical connection between said contact pins when they are so swivelled.

14. A reservoir warning arrangement according to claim 13, wherein said contact pins are swivelled about a horizontal pivot.

15. A reservoir warning arrangement according to claim 14, wherein each of said contact pins are supported by an annular member projecting into an associated bore contained in a contact carrier fastened to said reservoir.

16. A reservoir warning arrangement according to claim 14, wherein each of said contact pins are supported by a plastic ring secured in the inner surface of an associated bore contained in a contact carrier fastened to said reservoir.

17. A reservoir warning arrangement according to claim 14, wherein each of said contact pins are supported by an annular member projecting into an associated bore contained in a contact carrier fastened to said reservoir and a plastic ring secured in the inner surface of said associated bore.

18. A reservoir warning arrangement according to claim 17, wherein each of said annular members engage an annular groove of an associated one of said contact pins.

19. A reservoir warning arrangement according to claim 18, wherein each of said annular members has a triangular cross-section.

20. A reservoir warning arrangement according to claim 19, wherein a surface of said triangular cross-section extending perpendicular to said contact pins engages said annular groove to prevent said contact pins from being pulled out of said contact carrier.

21. A reservoir warning arrangement according to claim 20, wherein the apex of said triangular cross-section provides said horizontal pivot.

22. A reservoir warning arrangement according to claim 21, wherein each of said annular members is disposed adjacent the end of said associated bore adjacent said float.

23. A reservoir warning arrangement according to claim 22, wherein each of said plastic rings is disposed intermediate the associated one of said annular members and the end of said associated bore remote from said float.

24. A reservoir warning arrangement according to claim 23, wherein said plastic rings are elastic to return said contact pins to their normal position.

25. A brake fluid reservoir warning arrangement which responds when the fluid level drops below a predetermined minimum level comprising:

two spaced contact pins extending into said reservoir;

a contact disc disposed on a float in said reservoir to electrically connect said contact pins together when said fluid level drops below said minimum level to light a lamp in a warning indicator circuit; and a checking arrangement to check said warning arrangement including a manually operated arrangement associated with said contact pins to provide an electrical connection therebetween to light said lamp when said warning indicator circuit is intact, said manually operated arrangement including an opening in a housing member fastened to said reservoir carrying said contact pins, said opening being coextensive with both of said contact pins to receive a metal member so that said electrical connection between said contact pins can be made.

26. A reservoir warning arrangement according to claim 25, wherein said opening is a slot.

27. A reservoir warning arrangement according to claim 26, wherein said slot is conformed to the shape of a metal coin.

28. A reservoir warning arrangement according to claim 25, wherein said opening is circular.

29. A reservoir warning arrangement according to claim 25, wherein said opening is rectangular.

30. A reservoir warning arrangement according to claims 28 or 29, wherein said opening accommodates a spring-mounted metal member which spans the space between said contact pins.

31. A reservoir warning arrangement according to claim 30, wherein said opening accommodates a pushbutton slidable therein and conformed to said opening, said pushbutton being disposed above said spring-mounted metal member to provide said electrical connection when pushed.

32. A reservoir warning arrangement according to claim 31, wherein said pushbutton and said spring-mounted metal member are formed as an integral unit.

* * * * *